United States Patent [19]

Stein et al.

[11] Patent Number: 5,056,175

[45] Date of Patent: Oct. 15, 1991

[54] FLOOR CLEANING MACHINE

[75] Inventors: Klaus Stein; Heinz Kaulig, both of Velbert, Fed. Rep. of Germany

[73] Assignee: Stein & Co. GmbH, Velbert, Fed. Rep. of Germany

[21] Appl. No.: 466,038

[22] Filed: Jan. 17, 1990

[30] Foreign Application Priority Data

Apr. 24, 1989 [DE] Fed. Rep. of Germany ..... 3913390

[51] Int. Cl.[5] ..... A47L 11/18

[52] U.S. Cl. ..... 15/49.1; 15/339; 51/176

[58] Field of Search ..... 15/49.1, 50.1, 50.2, 15/50.3, 52.1, 339, 354, 356; 51/170 PT, 176, 177, 178, 180

[56] References Cited

U.S. PATENT DOCUMENTS

| | | | |
|---|---|---|---|
| 4,418,342 | 11/1983 | Aschoff et al. | 15/52.1 |
| 4,679,271 | 7/1987 | Field et al. | 15/52.1 |
| 4,910,824 | 3/1990 | Nagayama et al. | 15/49.1 |

*Primary Examiner*—Edward L. Roberts

*Attorney, Agent, or Firm*—Thomas N. Ljungman

[57] ABSTRACT

In a floor cleaning machine with a driven brush roller, the invention specifies that the height of the brush roller can be adjusted automatically as a function of the torque. For this purpose, between the drive and the brush roller, a spring, which is tuned to the torque for the working phase, is employed as a coupling element. When deviations from the specified torque occur, actuating signals for an automatic height adjustment of the wheel are produced, until the specified torque of the brush roller is re-established.

20 Claims, 11 Drawing Sheets

FLOOR CLEANING MACHINE

BACKGROUND OF THE INVENTION

1. Field of the Invention

This invention relates to floor cleaning machines, in particular carpet cleaning machines, in the form of a brush vacuum cleaner with a motor-driven brush roller, which is located in a brush set with wheels facing the floor. The height of the brush roller can be adjusted to the current working conditions, such as pile height and brush wear, as the height of at least one wheel, can be adjusted to position the brush roller in relation to the floor 2. Description of the Prior Art Floor cleaning machines of this type are known to be an effective way to clean carpets. A distinction is made in the field of vacuum cleaners between machines with a motor which simultaneously vacuums and drives the brushes, and so-called two-motor machines. The prior art includes such brush vacuum cleaners in which the brush function is electronically monitored, by using the power absorbed by the brush drive motor as a measured variable. The electronic circuitry thereby indicates by means of a display whether the motor is operating under normal load or with a load which is below or above a specified threshold. An indication is thereby given whether the brush roller is sufficiently engaged in the carpet pile to obtain an effective cleaning. If it is not, the brush is reset by a manual adjustment of the wheel or of the brush roller itself, so that an optimal setting can be obtained.

In commercial applications, in particular in cleaning different types of carpets, the height must constantly be adjusted to obtain an effective cleaning. But in practice, such adjustments are made only to a limited extent.

OBJECT OF THE INVENTION

The object of the invention is to create an automatic height adjustment of the brush roller to the current conditions by simple means in order to make possible a good cleaning action on various surfaces, to keep the force required to push the machine low, and to guarantee that account is taken of the wear of the brush roller used.

SUMMARY OF THE INVENTION

This task is accomplished in accordance with the invention, in that, between the brush roller and the drive, there is an apparatus to measure the torque which occurs, and a comparison can be made with a specified torque for the working phase. Any variances detected can be generated as actuating signals for a motorized height adjustment of the wheel of the brush set to the specified torque of the brush roller.

A uniform torque can thereby be set on the brush rollers in a simple manner to achieve an optimal cleaning action, as that the type of floor to be cleaned, the height of the carpet pile and the wear of the brush roller can be automatically taken into account. At the same time, a good cleaning action can be obtained while keeping the force required to push the machine low.

In one simple configuration of the invention, there is a spring which acts as a coupling element between the drive and the brush roller, and which is tuned to the torque for the working phase. Between the brush roller and the drive, there are corresponding elements in the form of cam discs to hold control rails and contacts, so that when the torque deviates from the specified torque, a rotation of the cam discs is produced, and actuating signals are generated to adjust the height of the wheels.

With regard to the configuration of the control system, the invention proposes that the control rails are formed by electrical contact rails for raising and lowering on the one cam disc. Corresponding to the contact rails is a sliding contact on the other cam disc, and between the contact rails, there is no contact rail in the position for the specified torque.

As an overload protection, the drive for the brush roller is also coupled by means of a bolt to the cam disc. The bolt can move freely in a corresponding groove of the cam disc in the range of rotation for the actuating signals for the height adjustment. When the brush roller is blocked, there is a relative rotation of the cam discs to align an array of corresponding electrical contacts, which results in the electrical disconnection of the drive.

To create smooth operation during start-up, the invention proposes that the electrical circuitry include a delay circuit for the start-up phase of the drive motor.

In one favorable configuration, the belt pulley which is part of the drive system is designed so that its end surface simultaneously serves as the cam disc.

To protect the apparatus, in one configuration of the invention, there is a slip coupling designed as an overload protection between the belt pulley and the brush roller. Here, the belt pulley holds the slip coupling, in which a brake drum is connected with the brush roller, and the belt pulley has springs connected with brake linings.

Simple control is made possible in that the adjustable wheel can be controlled by means of an electrical servomotor with the interposition of a transmission.

In addition, to accomplish rapid adjustments with short actuator travel, the adjustable wheel is oriented by means of a cam. Alternatively, the invention proposes that the adjustable wheel can be oriented by means of an angled shaft.

The objects of the invention are provided in a preferred embodiment including a floor care machine or the like having a brush roller at a lower side of said machine and a drive for driving the brush roller. At least one wheel of the machine can be adjusted by an element for adjusting a height of the machine at the brush roller relative to the floor. The height is adjustable within a predetermined range of heights. There is included a device for detecting a torque transmitted between the brush roller and the drive relative to a predetermined range of torques. The device can detect a torque above the predetermined range of torques and generate a first signal for causing the element for adjusting to increase the height of the machine within the predetermined range of heights. The device can detect a torque below the predetermined range of torques and generate a second signal for causing the element for adjusting to decrease the height of the machine within the predetermined range of heights. The device can detect a torque within the predetermined range of torques to cause the element for adjusting to be deactivated to maintain the height of the machine.

BRIEF DESCRIPTION OF THE DRAWINGS

Embodiments of the invention are schematically illustrated in the accompanying drawings.

DESCRIPTION OF THE PREFERRED EMBODIMENT

Figure 1:
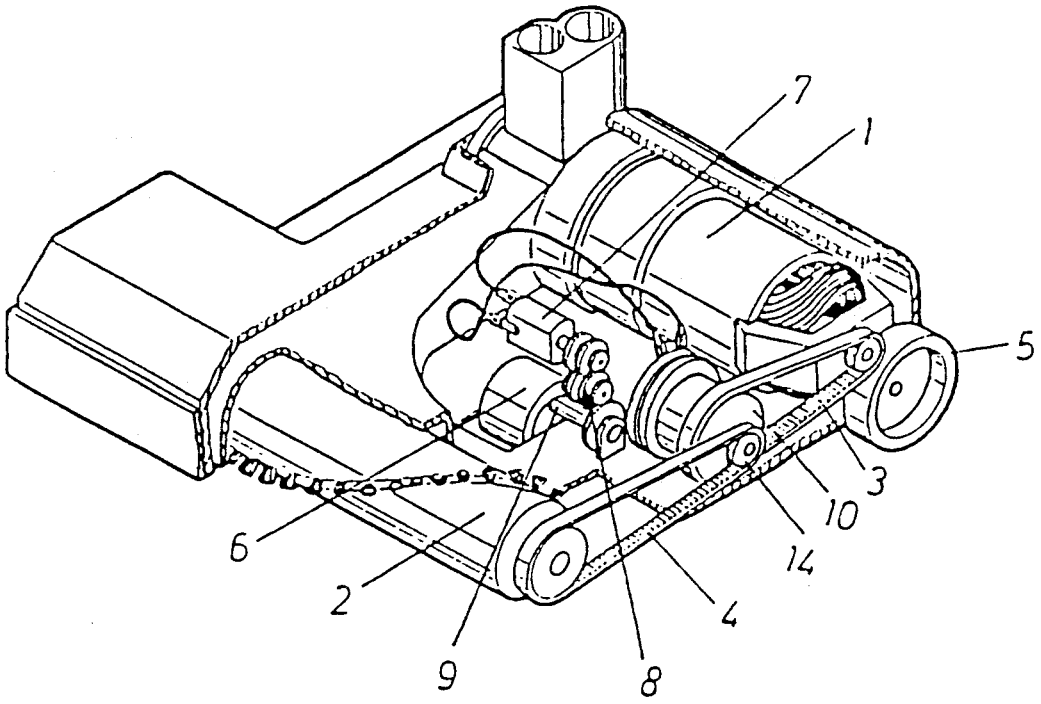
FIG. 1 shows a brush set in a perspective view.
Figure 2:
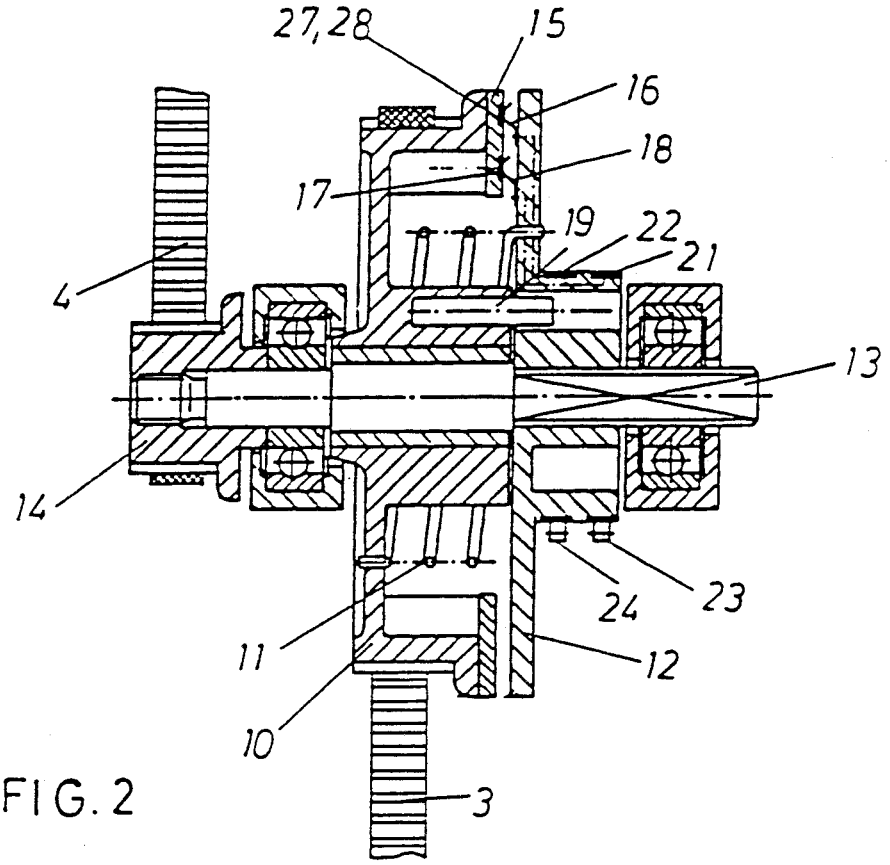
FIG. 2 shows a cross sectional view of a torque measurement and comparison apparatus with a spring.
Figure 3:
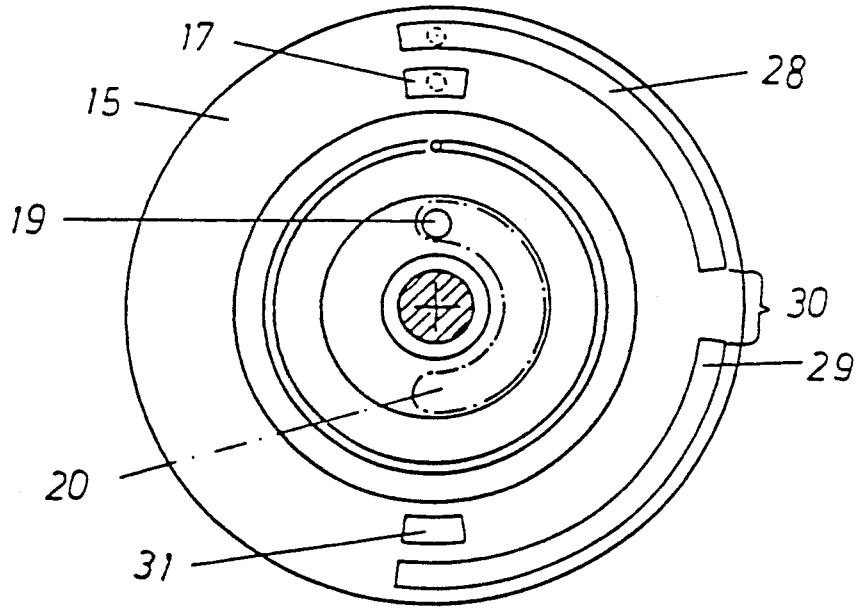
FIG. 3 shows a side view of a belt pulley, which is simultaneously designed as a cam disc with electrical contact rails.

The brush set, as illustrated in FIGS. 1, 2, 3, 4*a*, 4*b* and 5, holds a fan motor 1, which simultaneously drives a brush roller 2 by means of toothed belts 3 and 4. The entire brush set is supported on the floor by means of two rear wheels 5 and one front wheel 6. The height of the wheel 6 can be adjusted, so that the height of the brush roller 2 with its bristles can also be adjusted to the carpet pile to be cleaned. To adjust the wheel 6 there is a servomotor 7, which acts by means of a transmission 8 on the wheel 6. The wheel 6 is mounted by means of a cam 9, so that a large change in height can be effected by means of small actuator movements.

To make an adjustment to the floor to be cleaned, taking the carpet pile into consideration, the torque to be transmitted to the brush roller 2 is kept constant, and an adjustment of the wheel 6 is made accordingly.

For this purpose, the toothed belt 3, which is used as the drive, is guided over a belt pulley 10, and the drive power of the motor is transmitted with the interposition of a spring 11 tuned to the torque specified for the brush roller. The additional transmission of the drive movement takes place via a cam disc 12, which is attached by a keyed connection to a shaft 13. A belt pinion 14, which is mounted on the shaft 13, in turn drives the brush roller 2 via a belt 4. One end of the belt pulley 10 is designed as a cam disc 15 with electrical contact rails 28 and 29. The electrical contact rails 28 and 29 are used to generate an actuating signal to raise and lower the wheel 6, while an interrupted area 30 between the contact rails 28, 29 signals the correct adjustment of the wheel 6. For this purpose, the cam disc 15 has an associated cam disc 12, which supports a corresponding sliding contact 16 and is oriented in relation to the contact rails 28 and 29.

The cam disc 15 has an additional contact rail 31, which is oriented in relation to a sliding contact 18 of the cam disc 12. The contact rail 31 causes a disconnection of the fan motor 1 if the brush roller 2 is blocked. A bolt 19 on the belt pulley 10 is engaged in a groove 20 of the cam disc 12. The groove 20 is sized to correspond to the angle of rotation for the height adjustment.

If an overload is caused by a blocking of the brush roller 2 or excessive torque, the cam disc 12 rotates to the stop of the bolt 19, at which the sliding contact 18 is located on the contact rail 31, and the fan motor is shut off. The sliding contacts 16 and 18 are connected with corresponding sliding rails 21, 22. As a result, the signals are transmitted via corresponding contacts 23, 24, and are conducted as actuating signals to a control circuit.

The torque produced by the brushes can become increasingly smaller because of bristle wear, and a readjustment by retracting the wheel is no longer possible. When the wheel has reached its limit position, the sliding contact 18 reaches the sliding rail 17, and a signal is given to replace the brushes.

The spring 11 should be tuned to the torque to be transmitted for an optimal operation of the brush roller 2. The turning of the spring 11 should hold the cam discs 12, 15, in the presence of this torque, in an orientation so that the sliding contact 16 is in the area 30 between the contact rails 28 and 29.

When the cam discs 12, 15 are relatively rotating in the vicinity of the contact rail 28, the torque taken from the brush roller 2 is too low. Consequently, the brush roller 2 must be lowered, since it is not digging deeply enough into the carpet pile. In such a case, by means of the contact rail 28, the sliding contact 16, the sliding rail 21 and the contact 23, an actuating signal is generated for the servomotor 7 to retract the wheel 6 and thus lower the brush roller 2. This reaction will continue until the specified torque is reached and the sliding contact 16 is once again in the area 30 between the contact rails 28 and 29.

When changing to a carpet with a longer pile, a higher torque necessarily occurs, since the brush roller 2 sinks deeper into the carpet. The corresponding cam discs 12, 15 are thereby rotated by means of the interposed spring 11 so that the sliding contact 16 is in the vicinity of the contact rail 29. As a result, corresponding actuating signal is generated for the servomotor 7 to extend the wheel 6, so that the brush roller 2 is raised and the specified torque is again reached.

In practice, the torque on the brush roller 2 can be sharply increased by foreign objects sucked in, such as scraps of paper and string. In such a case, the cam discs 12, 15, rotate opposite one another until the bolt 19 encounters the stop at the end of the groove 20, and the sliding contact 18 would be located on the sliding rail 31, whereupon the fan motor 1 would be disconnected.

So that the machine is not turned off when short-term changes in torque occur during operations, e.g. changes in the direction of movement, the preferred control system includes a delay circuit, to guarantee smooth operation.

Figure 4A:
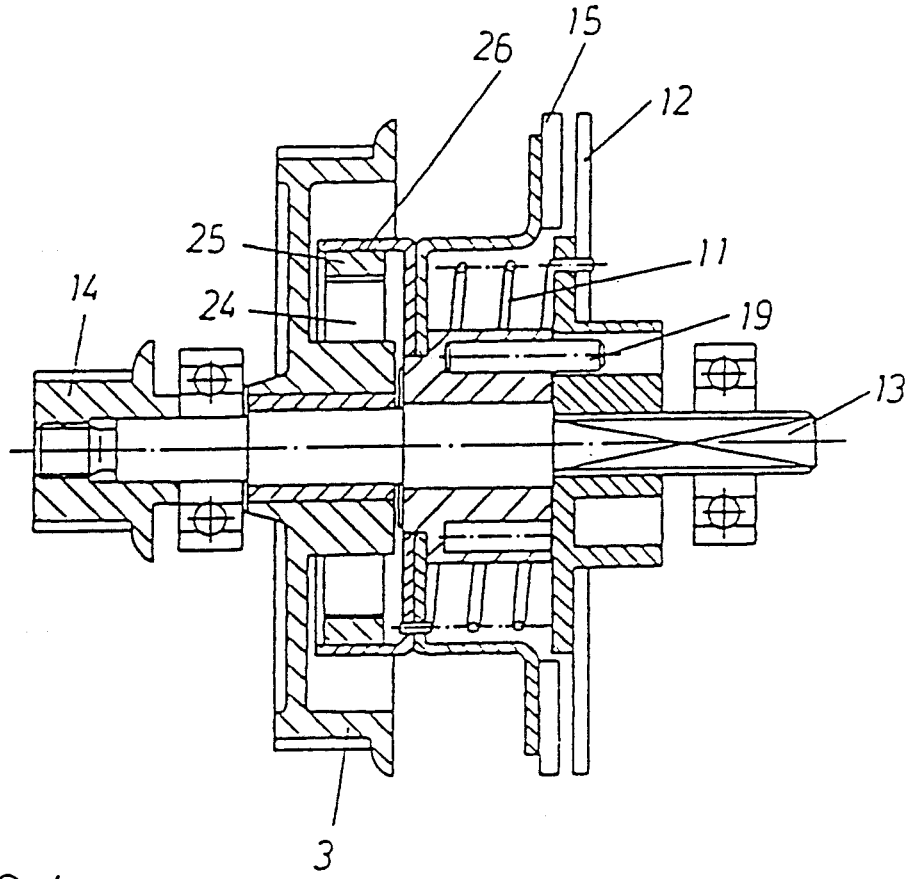
FIG. 4*a* shows an alternative embodiment of an adjustment apparatus with a slip coupling.

In the alternative embodiment illustrated in FIG. 4*a*, a slip coupling is installed parallel to the spring 11. For this purpose, springs 24 are connected to the belt pulley 10 and have brake linings 25. The brake linings 25 transmit the torque to the brush roller 2 through a corresponding brake drum 26 associated with the cam disc 15. The tension of the springs 24 is thereby set to a maximum torque. When there is an extreme increase in the torque, or if the brush roller is blocked, the brake linings 25 slide in the brake drum 26, and no damage occurs to the drive system.

Figure 4B:
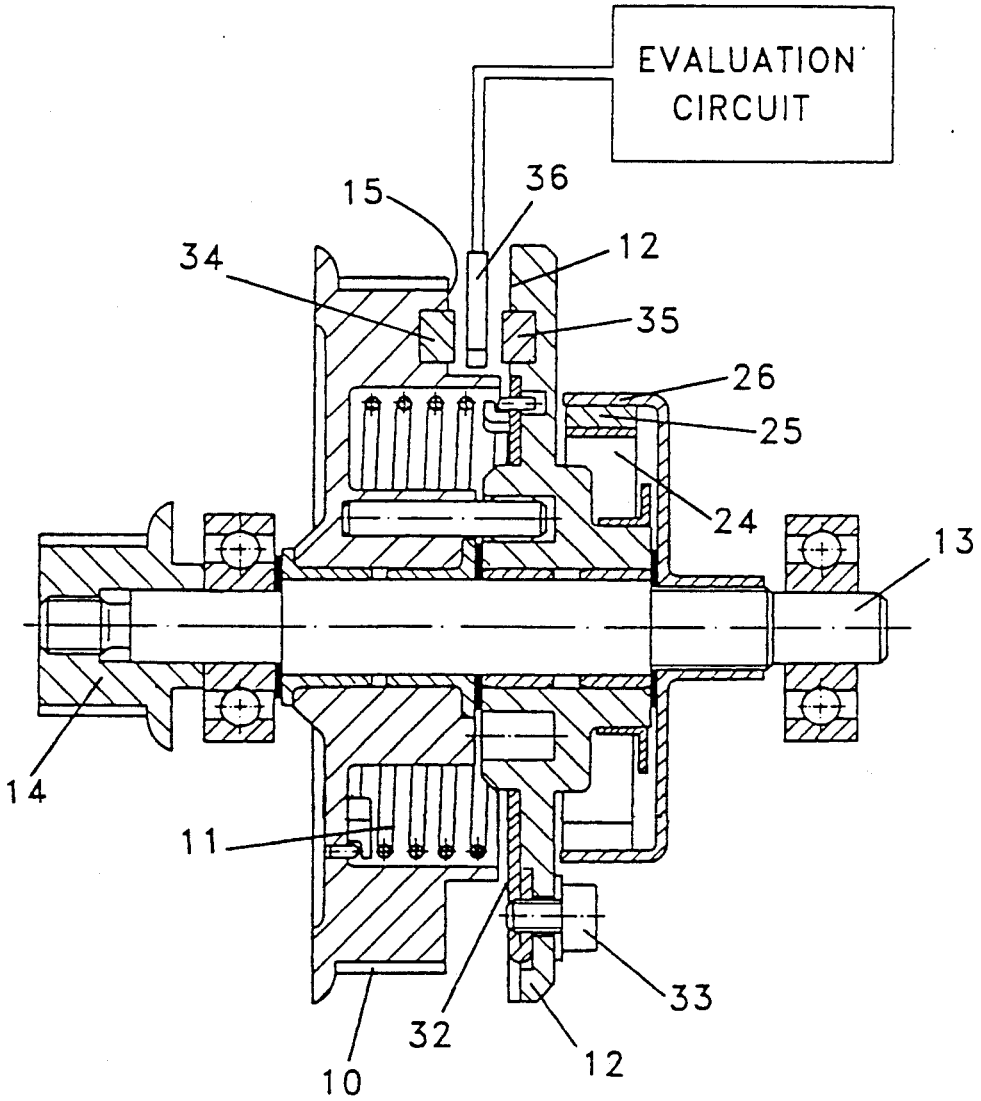
FIG. 4*b* allows another alternative embodiment of an adjusting apparatus with a slip coupling.

As seen in FIG. 4*b*, another alternative embodiment of the invention includes means for generating an adjustment control signal for the lowering or raising of the roller 6 of the brush set. A slipping clutch unit, similar to that employed in the embodiment shown in FIG. 4*a*, again employs a spring 24, brake linings 25 and a brake drum 26. The brake drum is mounted on one end of the shaft 13 and the belt pinion 14 mounted on the other end of the shaft 13. A belt pulley 10 is to be driven by the fan motor 1 but is connected more directly to the cam disc 12, by way of a spring 11, which is similar to the spring 11 of the embodiment shown in FIG. 4*a*. Specifically, the spring 11 is connected to the cam disc 12 through an adjustment washer 32. The adjustment washer 32 is connected to the cam disc 12 in a geared manner and can be held in place after adjustment by a set screw 33. As a result, the embodiment shown in FIG. 4*b* includes a means for adjusting the spring tension until a desired position and resulting spring value is obtained. Adjustment in this manner is important because the dispersion of the spring power or load is sometimes greater than those forces which are generated at the spring through the different loads on the brush. The embodiment shown in FIG. 4*b* employs the slipping clutch unit in a different relative position than that of the embodiment in FIG. 4*a*, while still generally performing the same function.

More significantly, the embodiment shown in FIG. 4*b* does not employ the same means for determining the angle of rotation of the two cam discs 12 and 15. The embodiments discussed hereinabove generally employ contact rails and sliding contacts for evaluating the relative angular position of the cam discs. On the other hand, the embodiment of FIG. 4*b* employs a contactless measurement of the relative angle of rotation. For this purpose, cam disc 12 and cam disc 15 are respectively provided with magnets 35 and 34. The relative angular distance or displacement of the magnets 34 and 35 depends on the amount of torque created and the corresponding relative rotation therebetween. The magnets 34 and 35 are employed to alternately excite a sensor 36, which is located between the cam disks 12 and 15. The sensor 36 functions as a Hall generator, producing an impulse-pulse-relationship, which can be evaluated in an associated electronic circuitry such as, for example, a microprocessor. The control instructions generated in such a microprocessor in this manner would again be forwarded to the servomotor 7, which acts by means of the transmission 8 for the adjustment of the wheel 6.

Figure 5:
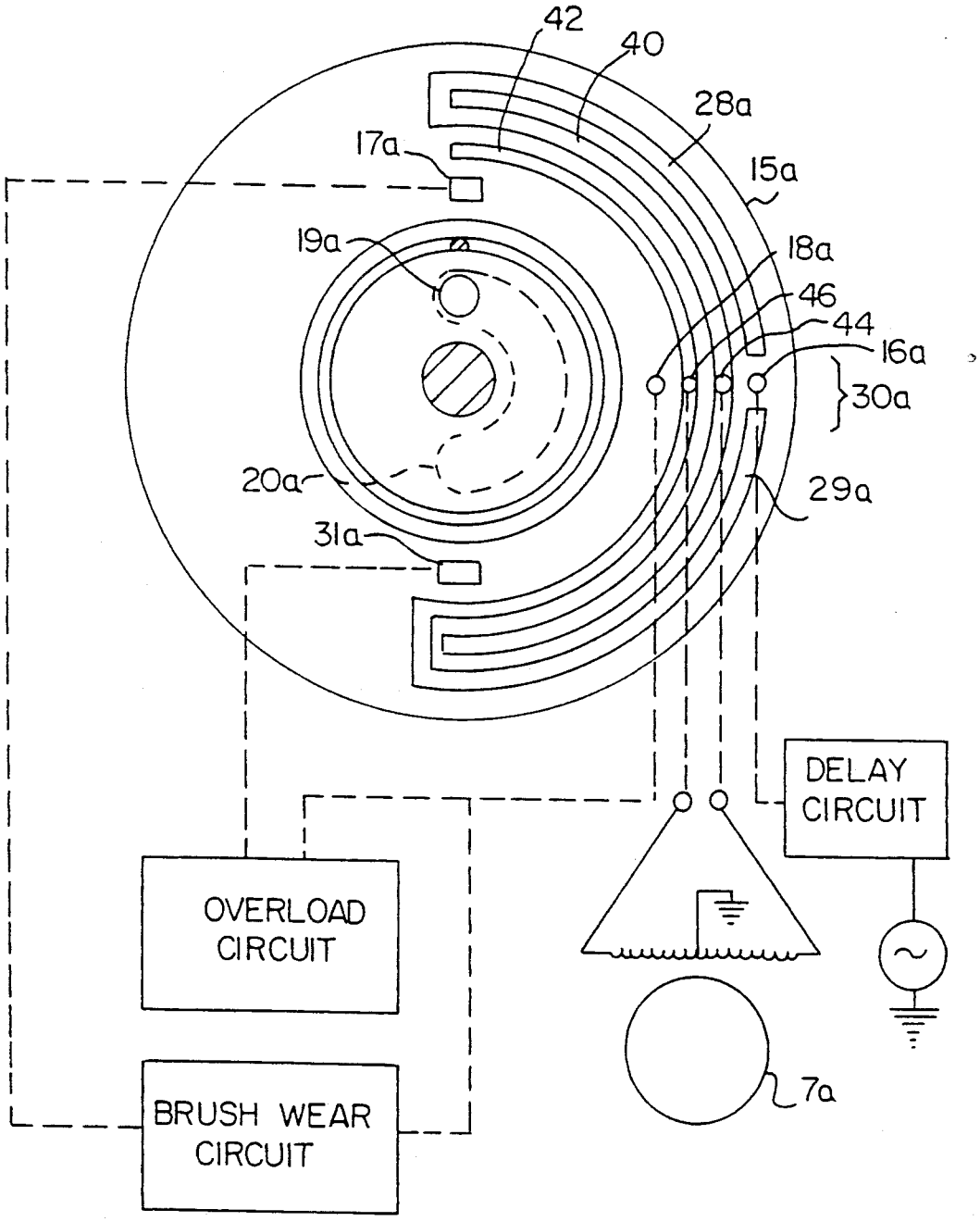
FIG. 5 shows a side view of a belt pulley including an alternative cam disc configuration and a schematic representation of other features of the invention.

As seen in FIG. 5, an alternative disc configuration includes contact rails 28*a* and 29*a* which are similar to contact rails 28 and 29 discussed hereinabove. Additionally, an interrupted area 30*a* provides the same function as did the interrupted area 30 discussed above. For this configuration, the sliding contact 16*a* is again aligned with the contact rails 28*a* and 29*a* for operation of the servomotor represented by the rotor 7*a*.

In order to connect the contact rails 28*a* and 29*a* respectively to the windings of the servomotor of 7*a*, the contact rail 28*a* is electrically connected at the ends thereof to a semi-circular contact rail 40 while the contact rail 29*a* is electrically connected at the ends thereof to a semi-circular contact rail 42. With associated sliding contacts 44 and 46 respectively mounted on the other cam disc (not shown) in the same manner as the sliding contacts 16*a* and 18*a*, a current can be transferred through corresponding sliding rails on the other cam disc which are similar to sliding rails 21, 22 which are electronically connected to the sliding contacts 16 and 18 in the embodiment shown in FIG. 2. Consequently, current passing through the contact rails 40 and 42 and associated sliding contacts 44 and 46 are capable of providing appropriate current to the windings of the servomotor 7*a* for either raising the height of the wheel or lowering the height of the wheel in the same manner as discussed hereinabove.

Additionally, as seen in FIG. 5, the sliding contacts 16*a*, 18*a*, 44 and 46 are shown in the position of preferred torque so that the contact 18*a* is not aligned with either of the contact rails 17*a* and 31*a* which are similar to the contact rails 17 and 31 as discussed hereinabove. Again, as discussed hereinabove, when sliding contact 18*a* is aligned with the contact rail 31*a* an overload condition will be transmitted to the overload circuitry for turning the fan motor off. In a similar manner, when the sliding contact 18*a* is aligned with the contact rail 17*a*, a signal will be transmitted to the brush wear circuitry to indicate that the brush roller should be replaced.

As also seen in FIG. 5, upon initial activation of the fan motor, the torque applied to the brush roller will not be in a stabilized condition. Accordingly, the power to the sliding contact 16 can be temporarily interrupted by a delay circuit to allow stabilization of the torque prior to any indication of whether the wheel should be raised or lowered in response to the torque on the brush roller.

It should be clear that the alternative embodiment shown in FIG. 5 includes the various features of the invention as included in the embodiments discussed hereinabove but in a different form.

Figure 6:
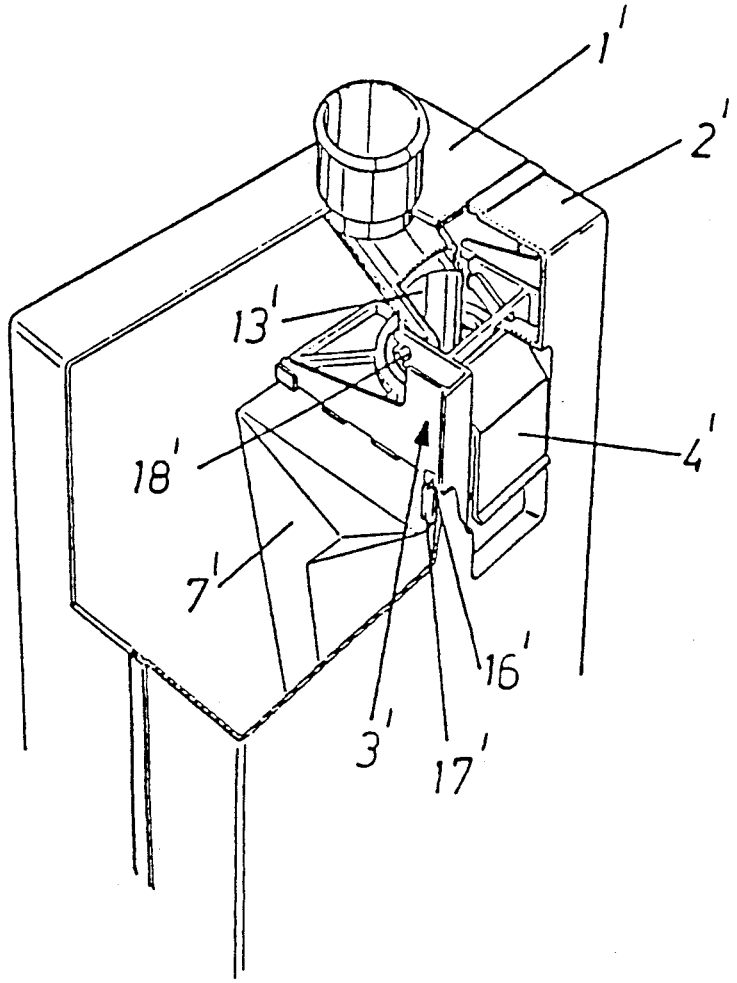
FIG. 6 shows the upper portion of a vacuum cleaner in the working position.
Figure 7:
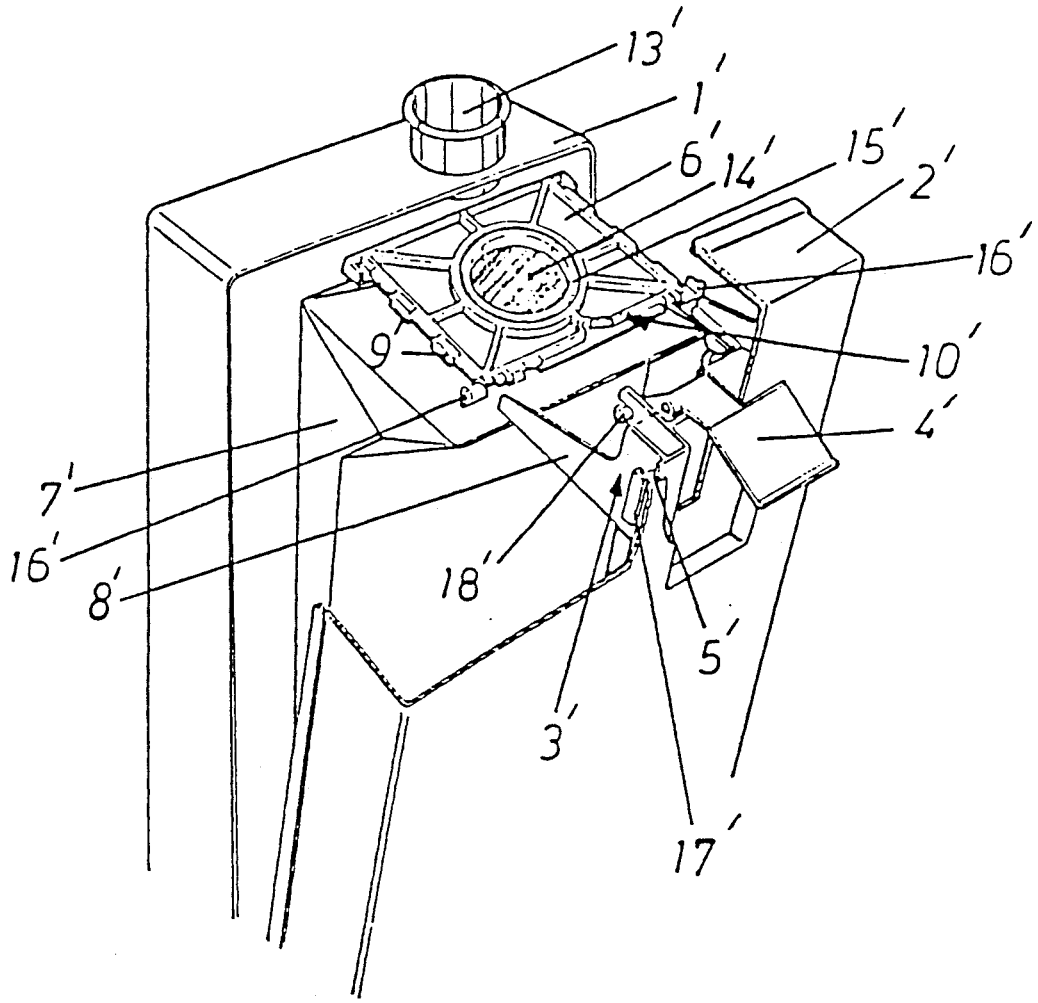
FIG. 7 is an illustration of the same portion, as in FIG. 6, in the position for replacing the filter bag.
Figure 8:
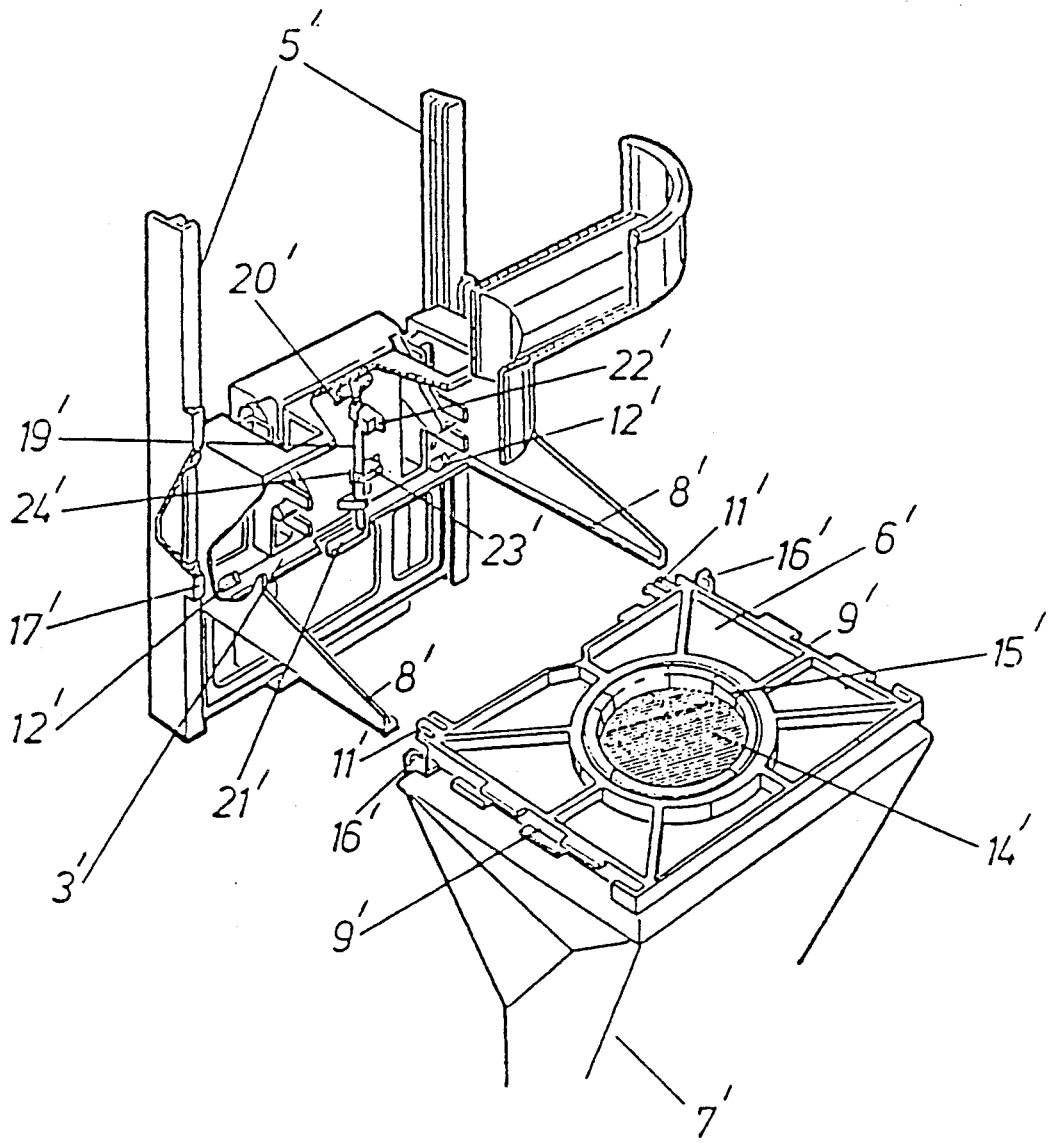
FIG. 8 is an enlarged view of the guide element with the corresponding reinforcement plate of the filter bag in the replacement position.

As seen in FIGS. 6, 7 and 8, the illustrated arrangement comprises essentially a vacuum cleaner having a housing 1' with a removable cover 2', which can be inserted in the lower portion of the housing and is mounted so that it can be pivoted. Air is drawn into the housing 1' by a blower and motor at the bottom of the housing through connecting hose means and a fixed filter tube 13' to create a suction on a filter bag 7' mounted therein. In the cover 2', there is a vertically adjustable guide element 3', which can be displaced from its lower position (FIG. 7) into its upper position (FIG. 6) by means of an externally-operated control element 4' in the form of a mechanical lever. For this purpose, the guide element 3' is mounted so that it can move vertically by means of rails 5' in the cover 2'.

The guide element 3' also holds a reinforcement plate 6' of the filter bag 7' and, for that purpose, has mounting rails 8' for the lateral mounting of the reinforcement plate 6'. The reinforcement plate 6' has a corresponding mounting groove 9' which is discontinuous in places. This arrangement guarantees a fixed orientation between the reinforcement plate 6' and the guide element 3'. As best seen in FIGS. 7 and 8, on the inserted end 10' of the reinforcement plate 6', there are catches 11', corresponding to which there are recesses 12' in the guide element 3' for the corresponding mounting. As a result, the reinforcement plate 6' of the filter bag 7' is precisely positioned and held in the guide element 3' at an installed position.

To transport the dirt picked up by the vacuum cleaner a hose or other device (not shown) is connected to the fixed filler tube 13'. The fixed filter tube 13' is rigidly mounted in the housing 1', while the reinforcement plate 6' of the filter bag 7' has a filler opening 14' and a sealing lip 15'. The filler opening 14' of the reinforcement plate 6', after the correct insertion into the guide element 3', is thereby a direct extension of the filler tube 13'.

The reinforcement plate 6' also has lateral locking lugs 16', which, when installed in the guide element 3', have corresponding brackets 17' on the cover 2', and are engaged with one another when the guide element 3' is displaced upwardly.

As a result of the folding of the control element 4', when the cover 2' is installed and closed, a lever joint 18' displaces the guide element 3' in the rails 5' in the cover 2'. As a result, the inserted reinforcement plate 6' with its filler opening 14' and the sealing lip 15' are pushed over the filler tube 13' of the housing 1'.

To prevent the cover 2' from being closed when no filter bag 7 is installed at the installed position, and also to check on other functions, there is a control shaft 19' in the guide element 3', held by means of a return spring 20'. The control shaft has corresponding cams 21', 22' and 23'.

The following measures guarantee safe operation:

1. When the reinforcement plate 6' of the filter bag 7' is inserted into the guide element 3' to the installed position, a corresponding cam 21' is engaged by the inserted end 10' and rotates the control shaft 19' (to the position shown in FIG. 8) so that a cam 22' is positioned for closing of the cover 2'. Engagement of cam 21' to the position of FIG. 8 causes clock-wise rotating of the shaft 19' (when viewed from above) against the biasing of the return spring 20'. If the closing movement of the cover 2' is executed in the absence of the reinforcement plate 6' of the filter bag 7', or if the reinforcement plate 6' of the filter bag 7' is missing, the cam 22' impacts a corresponding aligned portion of the filler tube 13', such as a tab, fin or the like, to prevent rotation of the control shaft 19' to the position as shown in FIG. 8.

2. The control element 4' can only be adjusted if the filter bag 7' with the reinforcement plate 6' has been inserted, and the cover 2' is closed on the housing 1'. Otherwise, the cam 23' prevents the adjustment. By inserting the reinforcement plate 6', the initial rotation of the control shaft 19' occurs, as seen in FIG. 8, but the cam 23' does not yet release the corresponding lock 24' and thus prevents the upward movement of the guide element 3' relative to the cover 2'.

Only when the cover 2' is installed on the housing 1' is a further rotation of the control shaft 19' (in a clockwise direction when viewed from above) performed by means of the cam 22' as it is cammed past the corresponding aligned portion of the filler tube 13'. Consequently, the cam 23' releases the corresponding lock 24' to allow the upward movement of the guide element 3'. Only then can the activator element 4' be adjusted, to raise the guide element 3' and push the reinforcement plate 6' with its filler opening 14' over the filler tube 13'.

3. The cover 2' is locked to the housing 1' by the upward movement of the guide element 3'. As a result of this movement, the locking lugs 16' located on the reinforcement plate 6' are pushed behind the brackets 17' located on the cover 2'. With the cover 2' rigidly connected with the reinforcement plate 6' and the reinforcement plate again engaged over the filler tube 13', the cover 2' is locked on the housing 1'.

Figure 9:
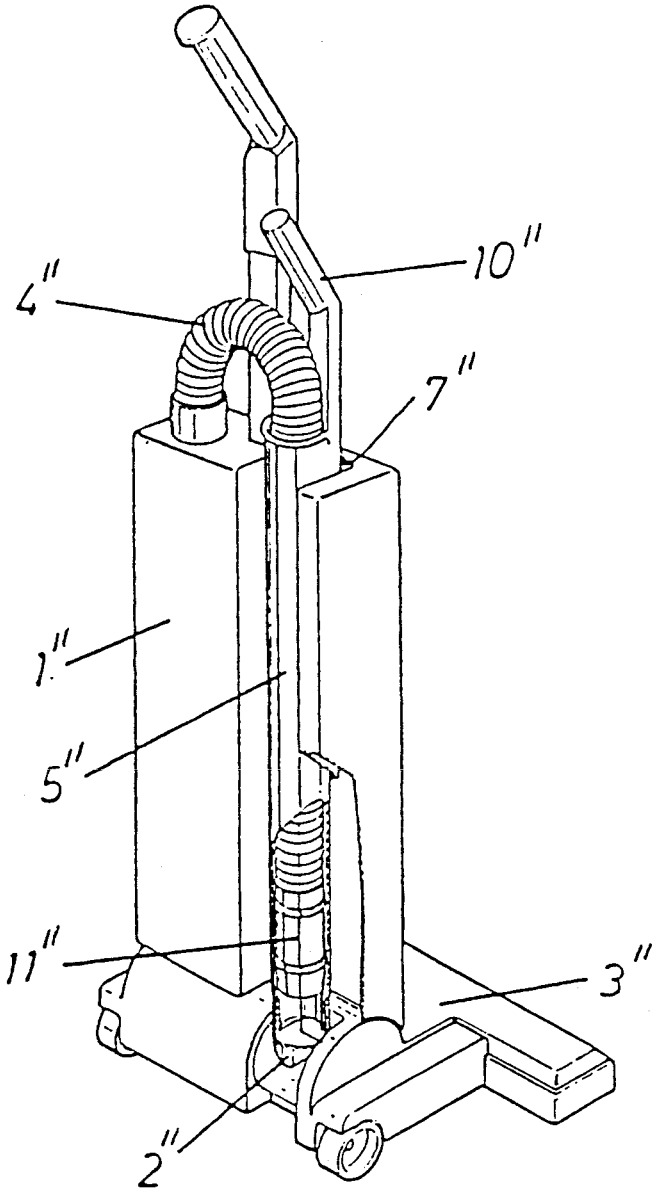
FIG. 9 shows an overall view of an upright brush-type vacuum cleaner for floor cleaning operations.
Figure 10:
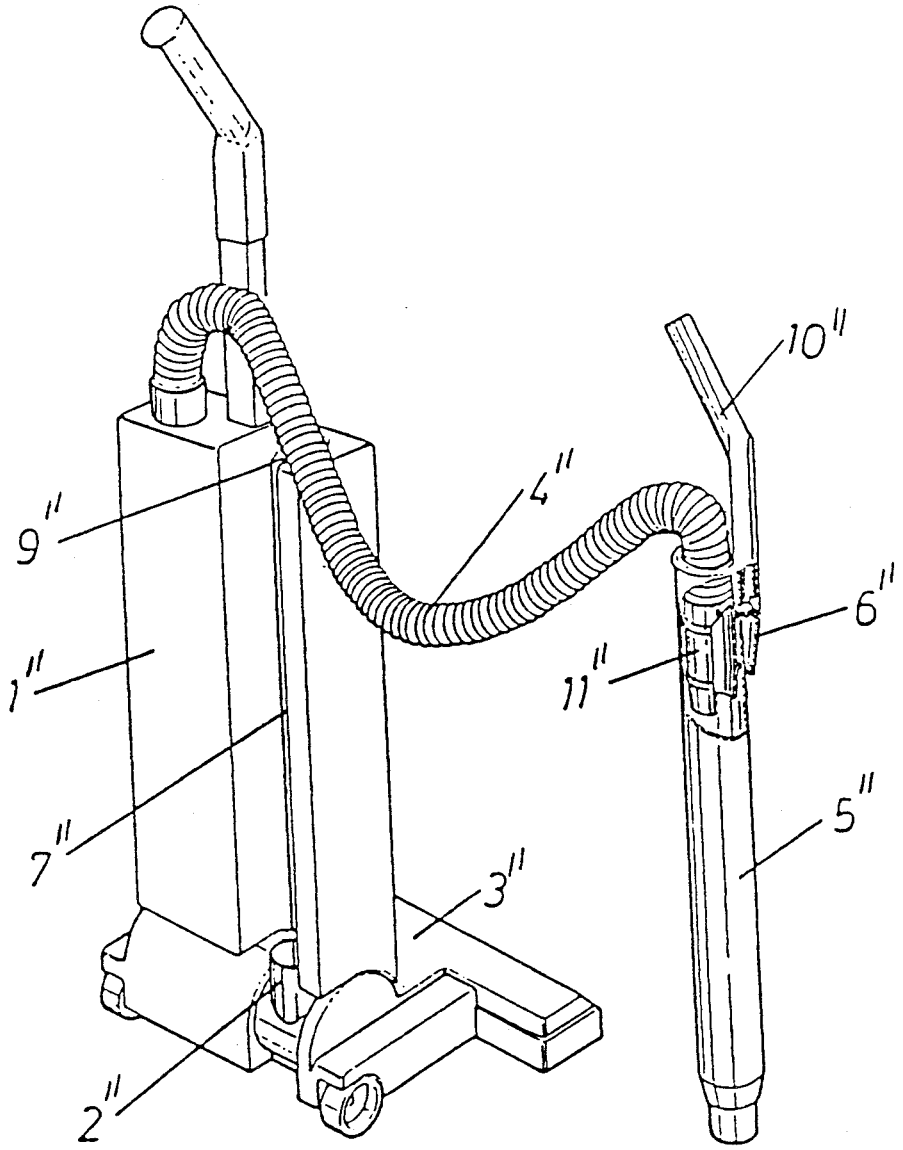
FIG. 10 shows a brush-type vacuum cleaner for auxiliary vacuuming operations with the hand-held vacuum tube.
Figure 11:
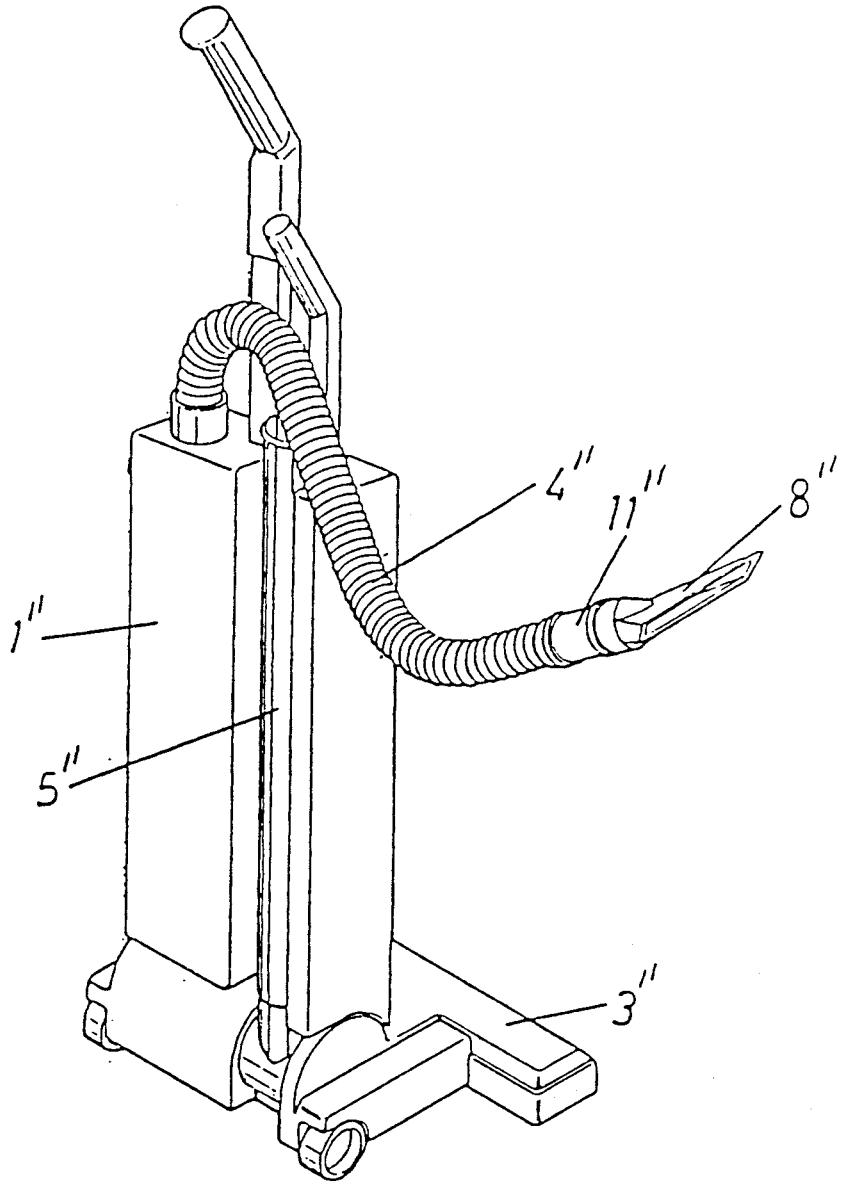
FIG. 11 shows an upright brush vacuum cleaner for auxiliary vacuuming operations with a hand-held vacuum hose, which is separated from the vacuum tube, with a working nozzle installed thereon.

The upright brush-type vacuum cleaner illustrated in FIGS. 9, 10 and 11 comprises a housing 1" with a handle which is designed as the filter cassette for a filter bag. In the lower portion there is a brush set 3" which is connected via a nozzle linkage 2" with a suction nozzle and can be rolled along the floor by means of corresponding wheels.

Connected to the upper portion of the housing 1" is the first end of a hand-held vacuum hose 4", which is supplied with working air by means of the suction nozzle. The hand-held vacuum hose 4" is detachably coupled with a hand-held vacuum tube 5". As best seen in FIG. 10, the end of the hand-held vacuum hose 4" with a vacuum mouthpiece 11" as a second end thereof connected via a detachable catch 6" with the corresponding end of the hand-held vacuum tube 5". As seen in FIG. 9, the hand-held vacuum tube 5" can be inserted in a recess 7" in the housing and is thereby connected at the lower end thereof with the nozzle linkage 2" leading to the vacuum nozzle. The hand-held vacuum tube 5" is thereby used as a storage site for the telescoping hand-held vacuum hose 4", located in the hand-held vacuum tube 5". The external portion of the hand-held vacuum hose 4" is thereby significantly shortened for normal floor vacuuming, which reduces vacuum losses and does not interfere with the operation of the machine. For floor vacuuming operation, in this position, a substantial portion of the hand-held vacuum hose 4" is disposed within the tube 5" and acts as an ascending line for the working air laden with dirt.

On the other hand, in the extended position of the hand-held vacuum hose 4" illustrated in FIG. 10, auxiliary vacuuming operations can be conducted over a large radius of action by means of the resulting extension of the hose 4" and the hand-held vacuum tube 5" which serves as a further extension. When the hand-held vacuum hose 4" is pulled out, it is fastened with its vacuum mouthpiece 11" on the end of the hand-held vacuum tube 5" by means of the catch 6" to prevent the hand-held vacuum tube 4", with its vacuum mouthpiece 11", from being sucked back in during operation. The catch 6" may be a pivoted member which is normally biased inwardly to extend into the interior of the tube 5" through an opening in the side wall thereof. The inward end of the catch can be notched or grooved to align with and engage raised portions on the mouthpiece 11" to prevent its insertion into or extraction from the tube 5".

For special auxiliary vacuuming operations, the vacuum mouthpiece 11" of the hand-held vacuum hose 4" is removed from the handheld vacuum tube 5" by moving the catch 6" against the biasing to release the mouthpiece 11". As shown in FIG. 11, the vacuum tube 5" is replaced by appropriate slip-on operating nozzles 8".

With the mouthpiece inserted in the tube 5", the catch 6", when the hand-held vacuum tube 5" is inserted in the housing 1", is unlocked by an edge 9", and thus the manual vacuum hose 4" can be removed. The edge 9" can include a camming surface which acts on the lower end of the catch 6" to cause it to move outwardly against the biasing. To improve handling, the hand-held vacuum tube is extended by means of a handle 10".

After the auxiliary vacuuming operations have been completed, the vacuum mouthpiece 11" is inserted or screwed back into the hand-held vacuum tube 5", which is located in the recess 7" in the housing 1". Again, the edge 9" prevents the catch from engaging and entrapping the mouthpiece 11" at the outer end of the tube 5". When the fan motor is running, the hand-held vacuum hose 4" is automatically retracted by the underpressure in the hand-held vacuum tube 5'', until the vacuum mouthpiece 11'' assumes the position indicated in FIG. 9.

In summary, the preferred adjustment apparatus is for floor care machines, in particular carpet cleaning machines, in the form of a brush vacuum cleaner with a motor-driven brush roller. The brush roller is located in a brush set facing the floor with wheels. To adjust the brush roller to the current working conditions, such as pile height and brush wear, there is at least one wheel, the height of which can be adjusted to set the brush roller in relation to the floor. The adjustment apparatus is characterized by the fact that between the brush roller 2 and the drive 1 there is an apparatus 11 to measure the torque which occurs, so that a comparison can be made with a torque preset for the operating phase. Any variances detected can be produced as actuating signals for a motorized adjustment of the height of the wheel 6 of the brush set to the specified torque of the brush roller 2.

The adjustment apparatus can be characterized by the fact that between the drive 1 and the brush roller 2, there is a coupling element in the form of a spring 11 which is tuned to the torque specified for the working phase. Between the brush roller 2 and the drive 1 there are corresponding elements in the form of ca discs 12, 15 to hold control rails 17, 28, 29, 31 and contacts 16, 18, such that when the torque deviates from the specified torque, there is a resulting rotation of the cam discs 12, 15 and actuating signals are produced to adjust the height of the wheel 6.

The adjustment apparatus may be characterized by the fact that the control rails are formed by electrical contact rails 28, 29 for raising and lowering on the one cam disc 15 which correspond to a sliding contact 16 on the other cam disc. Between the contact rails 28, 29, there is no contact rail 30 in the position for the specified torque.

The adjustment apparatus can also be characterized by the fact that the drive 1 for the brush roller 2 is also coupled by means of a bolt 19 to the cam disc 12. The bolt moves freely in a corresponding groove 20 of the cam disc 12 in the range of the rotation for the height adjustment actuating signals. When the brush roller 2 is blocked, a rotation of the cam disc 12 with an array of corresponding electrical contacts 17, 18 can be performed to electrically disconnect the drive 1.

The adjustment apparatus may be characterized by the fact that the electrical circuitry is preceded by a delay circuit for the start-up phase of the drive motor 1.

The adjustment apparatus may also be characterized by the fact that a belt pulley 10, which is part of the drive system, is simultaneously designed so that its end surface serves as the cam disc 15.

Still further, the adjustment apparatus can be characterized by the fact that between the belt pulley 10 and the brush roller 2, there is a slip coupling 24, 25, 26 which acts as an overload protection. The pulley wheel 10 can hold the slip coupling, so that the brake drum 26 is connected with the brush roller 2, and the pulley wheel 10 has springs 24 connected with brake linings 25.

Additionally, the adjustment apparatus can be characterized by the fact that the adjustable wheel 6 can be controlled by means of an electrical servomotor 7, with the interposition of a transmission 8.

Although, the adjustable wheel 6 can be oriented by means of a cam 9, the adjustable wheel 6 is preferably oriented by means of an angled shaft.

The adjustment apparatus may also be characterized by the fact that between drive motor 1 and brush roller 2 there is a spring 11 which is being used as a coupling which coordinates the torque for the operational phase. Between brush roller 2 and motor 1 there are corresponding elements in the manner of cam discs 12, 15 to hold magnets 35, 34 with an assigned sensor 36, like a Hall generator, being mounted therebetween. These elements are attached in such a way so that, when the torque deviates from the specified torque, a rotation of cam discs 12 and 15 occurs and is sensed as an impulse-pause-relationship by the sensor 36 which will forward a corresponding adjustment signal for the height adjustment of the roller 6 through a evaluation circuit.

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The invention as described hereinabove in the context of a preferred embodiment is not to be taken as limited to all of the provided details thereof, since modifications and variations thereof may be made without departing from the spirit and scope of the invention.

What is claimed is:

1. A floor care machine or the like comprising:

a lower side;

a brush roller disposed on the lower side of said machine, said brush roller comprising brush means disposed thereon;

drive means for driving the brush roller;

a plurality of wheels disposed on the lower side of said machine;

adjusting means for adjusting at least one of said wheels of said machine, said adjusting being for at least one of increasing and decreasing a height of said machine at said brush roller relative to the floor;

said height being adjustable within a predetermined range of heights;

detecting means for detecting a torque transmitted between said brush roller and said drive means;

said detecting means being for generating a first signal upon said torque exceeding a predetermined range of torques, said first signal being for causing said adjusting means to increase said height of said machine within said predetermined range of heights;

said detecting means being for generating a second signal upon said torque falling below a predetermined range of torques, said second signal being for causing said adjusting means to decrease said height of said machine within said predetermined range of heights; and said detecting means being for deactivating said adjusting means upon said torque being within said predetermined range of torques, said deactivating being for maintaining said height of said machine.

2. The floor care machine according to claim 1, wherein:

said detecting means comprises a coupling element between said brush roller and said drive means;

said coupling element comprising a first disc and a second disc with biasing means therebetween;

said first disc and said second disc being displaceable angularly by said torque in opposition to biasing of said biasing means; and said detecting means further comprises means for detecting a relative angular displacement between said first disc and said second disc.

3. The floor care machine according to claim 2, wherein the angular displacement of said first disc and said second disc by said torque effects said relative angular displacement between said first disc and said second disc, said floor care machine further comprising:

means for limiting said relative angular displacement between said first disc and said second disc by said torque above a predetermined limit;

means for detecting a limited angular displacement caused by said means for limiting said relative angular displacement; and said means for detecting a limited angular displacement comprising means for stopping said drive means.

4. The floor care machine according to claim 3, wherein said means for limiting said relative angular displacement comprises bolt means on at least one of said first disc and said second disc and arcuate slot means on at least one of the other of said first disc and said second disc, said arcuate slot means being for receipt of said bolt means therein.

5. The floor care machine according to claim 2, wherein:

said first disc comprises a first control rails, and second control rail and an interrupted area between said first control rail and said second control rail;

said second disc comprises a sliding contact for being aligned with said first control rail, said second control rail and said interrupted area; and said biasing means being for moving said sliding contact into alignment with said first control rail upon said torque exceeding said predetermined range of torques, said second control rail upon said torque falling below said predetermined range of torques, and said interrupted area upon said torque being within said predetermined range of torques.

6. The floor care machine according to claim 5, wherein said adjusting means comprises a servomotor for operation in each of a first direction for increasing said height and an opposite second direction for decreasing said height;

said servomotor being electrically connected to said first contact rail, said second contact rail and said sliding contact;

said servomotor for being operated in said first direction by receipt of said first signal upon alignment of said sliding contact with said first contact rail;

said servomotor for being operated in said second direction by receipt of said second signal upon alignment of said sliding contact with said second contact rail; and said servomotor being inoperative upon alignment of said sliding contact with said interrupted area, 7. The floor care machine according to claim 6, wherein said servomotor comprises an output transmission for adjusting said at least one of said wheels.

8. The floor care machine according to claim 7, further comprising:

first drive belt means extending between said first disc and one of said drive means and said brush roller;

second drive belt means extending between said second disc and the other of said drive means and said brush roller;

said first disc comprising a first pulley for receipt of said first drive belt means thereon;

said second disc comprising a second pulley for receipt of said second drive belt means thereon;

slip coupling means disposed between said brush roller and said drive means;

said sip coupling means being for disconnecting said brush roller from said drive means upon said torque exceeding a predetermined limit, said disconnecting being for providing overload protection for said drive means;

said slip coupling means comprising a brake drum and spring biased brake linings;

means for delaying said adjusting means upon changes of said torque;

said detecting means comprising means for detecting a lowest height of said machine; and said means for detecting said lowest height comprising means for producing a warning signal indicating that said brush means are worn and need to be replaced.

9. The floor care machine according to claim 8, wherein:

the angular displacement of said first disc and said second disc by said tourque effects a relative angular displacement between said first disc and said second disc;

said detecting means comprises means for limiting said relative angular displacement between said first disc and said second disc;

said detecting means comprises means for detecting said limited angular displacement;

said means for detecting said limited angular displacement comprises means for deactivating said drive means;

said means for limiting said relative angular displacement comprises bolt means on at least one of said first disc and said second disc and an arcuate slot means on at least one of the other of said first disc and said second disc, said arcuate slot means being for receipt of said bolt means therein;

sensor means disposed between said first disc and said second disc, said sensor means being for providing said first signal upon said torque exceeding said predetermined range of torques, for providing no signal upon said torque being within said predetermined range of torques, and for providing said second signal upon said torque falling below said predetermined range of torques;

said sensor means comprising Hall generator means;

said Hall generator means comprising evaluation circuit means;

said first disc and said second disc comprising magnets for actuation of said Hall generator means;

said evaluation circuit means being for producing said first signal and said second signal;

said biasing means disposed between said first disc and said second disc being adjustable to a torque specified for a working phase of said floor care machine;

said control rails of said first disc comprising electrical contact rails;

said means for delaying said means for adjusting comprising a delay circuit;

means for orienting said at least one of said wheels, said means for orienting being mounted on the lower side of said machine;

said means for orienting comprising a cam; and said first pulley comprising a first end surface, said first end surface being for serving as said first cam disc.

10. The floor care machine according to claim 2, further including first drive belt means extending between said first disc and one of said drive means and said brush roller and second drive belt means extending between said second disc and the other of said drive means and said brush roller.

11. The floor care machine according to claim 10, wherein said first disc comprises a first pulley for receipt of said first drive belt means thereon and said second disc includes a second pulley for receipt of said second drive belt means thereon.

12. The floor care machine according to claim 2, wherein said detecting means comprises sensing means disposed between said first disc and said second disc, said sensing means being for providing said first signal upon said torque exceeding said predetermined range of torques, no signal upon said torque being within said predetermined range of torques, and said second signal upon said torque falling below said predetermined range of torques.

13. The floor care machine according to claim 12, wherein:

said sensing means comprises Hall generator means;

said Hall generator means comprises evaluation circuit means;

said first disc and said second disc respectively comprise magnets for actuation of said Hall generator means; and said evaluation circuit means being for providing said first signal and said second signal to said adjusting means.

14. The floor care machine according to claim 13, wherein:

said adjusting means comprises a servomotor for operation in each of a first direction for increasing said height and an opposite second direction for decreasing said height;

said servomotor comprises an output transmission for adjusting said at least one of said wheels;

first drive belt means extending between said first disc and one of said drive means and said brush roller;

second drive belt means extending between said second disc and the other of said drive means and said brush roller;

said first disc comprises a first pulley for receipt of said first drive belt means thereon;

said second disc comprises a second pulley for receipt of said second drive belt means thereon;

slip coupling means disposed between said brush roller and said drive means;

said slip coupling means being for disconnecting said brush roller from said drive means upon said torque exceeding a predetermined limit; and said slip coupling means comprising a brake drum and spring biased brake linings.

15. The floor care machine according to claim 1, further comprising slip coupling means between said brush roller and said drive means;

said slip coupling means being for disconnecting said brush roller from said drive means upon said torque exceeding a predetermined limit;

said disconnecting being for providing overload protection for said drive means.

16. The floor care machine according to claim 15, wherein said slip coupling means comprises a brake drum and spring biased brake lining.

17. The floor care machine according to claim 1, further comprising means for delaying said adjusting means upon changes of said torque.

18. The floor care machine according to claim 1, further comprising means for indicating a lowest height of said machine.

19. The floor care machine according to claim 18, further comprising:

said means for indicating said lowest height comprising means for producing a warning signal indicating said brush means are worn and need to be replaced;

means for orienting said at least one of said wheels, said means for orienting being mounted on the lower side of said machine; and said means for orienting comprising a shaft.

20. An adjustment apparatus for a floor care machine or the like having a brush roller at the lower side thereof driven by a motor, the machine having a plurality of wheels for supporting the machine above a floor, said adjustment apparatus comprising:

adjusting means for adjusting at least one of said wheels of the machine, said adjusting being for at least one of raising and lowering a height of the machine at the brush roller relative to the floor;

said height being adjustable within a predetermined range of heights;

detecting means for detecting a torque between the brush roller and the motor;

said detecting means being for causing said adjusting means to increase said height of the machine within said predetermined range of heights upon said torque exceeding said predetermined range of torques;

said detecting means being for causing said adjusting means to decrease said height of the machine within said predetermined range of heights upon said torque falling below said predetermined range of torques; and said detecting means deactivating said adjusting means to maintain the height of said machine upon said torque being within said predetermined range of torques.

* * * * *

UNITED STATES PATENT AND TRADEMARK OFFICE

CERTIFICATE OF CORRECTION

PATENT NO. : 5,056,175

DATED : October 15, 1991

INVENTOR(S) : Klaus Stein, et. al.

It is certified that error appears in the above-identified patent and that said Letters Patent is hereby corrected as shown below:

Column 9, line 26, delete "ca" and insert --cam--.

Column 11, line 3, delete "rails, " and insert --rail,--.

Column 11, line 3, delete "and" and insert --a--.

Column 11, line 61, delete "area," and insert --area.--.

Column 12, line 10, delete "sip" and insert --slip--.

Column 13, line 19, delete "includes" and insert --comprises--.

Signed and Sealed this

Twenty-third Day of February, 1993

*Attest:*

STEPHEN G. KUNIN

*Attesting Officer*

*Acting Commissioner of Patents and Trademarks*